US005626300A

United States Patent [19]

Kohler

[11] Patent Number: 5,626,300

[45] Date of Patent: May 6, 1997

[54] DISC REFINER WITH CONICAL RIBBON FEEDER

[75] Inventor: Gregory R. Kohler, Williamsport, Pa.

[73] Assignee: Andritz Sprout-Bauer, Inc., Muncy, Pa.

[21] Appl. No.: 434,017

[22] Filed: May 3, 1995

[51] Int. Cl.[6] ..... B02K 23/02

[52] U.S. Cl. ..... 241/247

[58] Field of Search ..... 241/247, 246, 241/261.2, 261.3; 162/23, 261

[56] References Cited

U.S. PATENT DOCUMENTS 2,172,151 10/1939 Dick ..... 241/247
3,076,610 2/1963 Rosenfeld et al. ..... 241/246
3,441,227 4/1969 Fisher .
4,163,525 8/1979 Reinhall ..... 241/247
5,034,099 7/1991 Nilsson ..... 162/23
5,076,892 12/1991 Fisher et al. .

*Primary Examiner*—Larry I. Schwartz
*Assistant Examiner*—Adrian L. Coley
*Attorney, Agent, or Firm*—Chilton, Alix & Van Kirk

[57] ABSTRACT

A feeder assembly for lignocellulosic chip refiner has a conical core having a major diameter end and a minor diameter end. A helically coiled ribbon is supported by and extends longitudinally in spaced relation with the core. The ribbon is defined by turns of increasing diameter extending from the minor to the major diameter end of the core. A conical feed housing surrounds the ribbon.

15 Claims, 3 Drawing Sheets

DISC REFINER WITH CONICAL RIBBON FEEDER

BACKGROUND OF THE INVENTION

The present invention relates to refiners for defibrating high consistency lignocellulosic chips and the like at superatmospheric heat and pressure, and more particularly, to the feeding of chips to the rotating disc or discs in such refiners.

The problem of feeding chips under superatmospheric heat and pressure, to the rotating discs of a disc refiner, have been addressed in a variety of ways including the use of a helical ribbon feeder in a cylindrical conveyor housing, mounted coaxially with the rotating disc. An example is shown in U.S. Pat. No. 5,076,892 (Fisher et al), wherein the ribbon feeder assembly not only conveys the chip material toward the refiner disc, but also permits the coaxial extraction of back flowing steam that has been generated at the disc by the refining process. In some instances, the ribbon feeder is driven independently of the main drive shaft of the disc, and in other instances, it is driven co-rotatably with such drive shaft.

As the chips are conveyed axially toward the inlet region of the rotating disc, the chips experience a very high centrifugal force, which urges the chips radially against the conveyor housing. The axial component of force, which is of primary importance for conveying the material toward the disc, is of significantly lesser magnitude. Although the helical ribbon shape itself provides some axial component for conveying the chips, a convenient way of providing additional axial force on the chips is desired, to overcome increased backflow steam forces that are generated as designers produce higher power refiners.

SUMMARY OF THE INVENTION

It is, accordingly, an object of the present invention, to provide an improved ribbon type feeder for a high consistency refiner, which increases the force applied in the conveying direction, relative to known ribbon feeders.

In a broad aspect of the invention, this objective is achieved by providing an elongated core having first and second ends, and a helically coiled ribbon supported by and extending longitudinally in spaced relation with the core. The ribbon is defined by turns having an increasing diameter along the core toward the first end. A feed housing including a conical portion closely surrounds the ribbon and has an opening through which chips can be introduced onto the ribbon.

In a more particular embodiment of the present invention, the objective is accomplished by a feeder mechanism, comprising an elongated core including a conical portion having a major diameter end attached at the hub of the rotating disc and a minor diameter end opposite the hub. A helically coiled ribbon is supported by and extends longitudinally with the core. The ribbon is defined by a plurality of turns having an increasing diameter along the core toward the major diameter of the core, so as to define a conveying channel between the ribbon and the core.

In the preferred embodiment, a high consistency refiner comprises a rotatable disc having a working face including a radially inner first inlet surface and a radially outer first grinding surface. A second inlet surface is juxtaposed with the first inlet surface, thereby forming an inlet gap which has an inlet entrance. A second grinding surface is juxtaposed with the first grinding surface, thereby forming a grinding gap extending substantially radially outwardly from the inlet gap. A shaft is connected to the disc for rotating the disc about a rotation axis. A feed mechanism is supported for rotation about the rotation axis, to advance feed chips toward the face of the disc and into the inlet gap. The feed mechanism includes a substantially helical ribbon defined by a plurality of coil turns, the turns having an increasing diameter such that the perimeter of the turn having the greatest diameter, is situated at the entrance to the inlet gap. The feed mechanism is part of a feed assembly which include a conical housing closely surrounding the conical ribbon. Means are provided for receiving feed material under pressure from outside the refiner, and directing the feed material through the feed housing to the ribbon of the feed mechanism.

The feed mechanism is preferably attached to the hub of the disc, for co-rotation therewith, i.e., both the disc and feed mechanism are driven by a common drive shaft, which preferably operates at 1500 rpm or more.

Preferably, the feed mechanism includes a core having a conical portion which increases in diameter in proportion to the increased diameter of the ribbon turns, thereby defining a substantially annular channel of substantially uniform cross sectional flow area, but with the outer diameter of the channel increasing in the direction toward the inlet gap at the disc.

As the chips are conveyed or transported along the ribbon, the centrifical force pushes the chips toward the outer diameter of the ribbon, against the feed housing. This centrifical force naturally increases with increased diameter of the ribbon. However, because of the conical shape of the ribbon, an additional component of force acting in the axial direction, forcibly pushes the fiber toward, and eventually into, the inlet gap at the refiner disc. This additional axial force, resulting from the conical shape, combined with the known efficiency of a high speed ribbon feeder, provides an enhanced capability to feed chips into the inlet gap, while extracting backflow steam. The backflow steam, as in a conventional ribbon feeder, moves away from the disc along the radially inner portion of the feed assembly channel.

Another significant advantage of the present invention, associated with the embodiment wherein the feed assembly is cantilevered from the disc hub and driven by the main drive shaft for the disc, permits steam to be extracted axially out of the refiner, directly from the ribbon feeder housing. Radial blades can be provided at the steam discharge end of the feed assembly, to enhance separation of fiber from discharging steam. This fiber can then be conveyed for re-entry into the refiner grinding zone.

The increased conveying zone available with the present invention, can also be beneficially implemented in refiners that operate at atmospheric pressure.

BRIEF DESCRIPTION OF THE DRAWINGS

These and other objects and advantages of the invention will be more evident from the description of the preferred embodiment, set forth below with reference to the accompanying figures, in which.

DESCRIPTION OF THE PREFERRED EMBODIMENT

Figure 1:
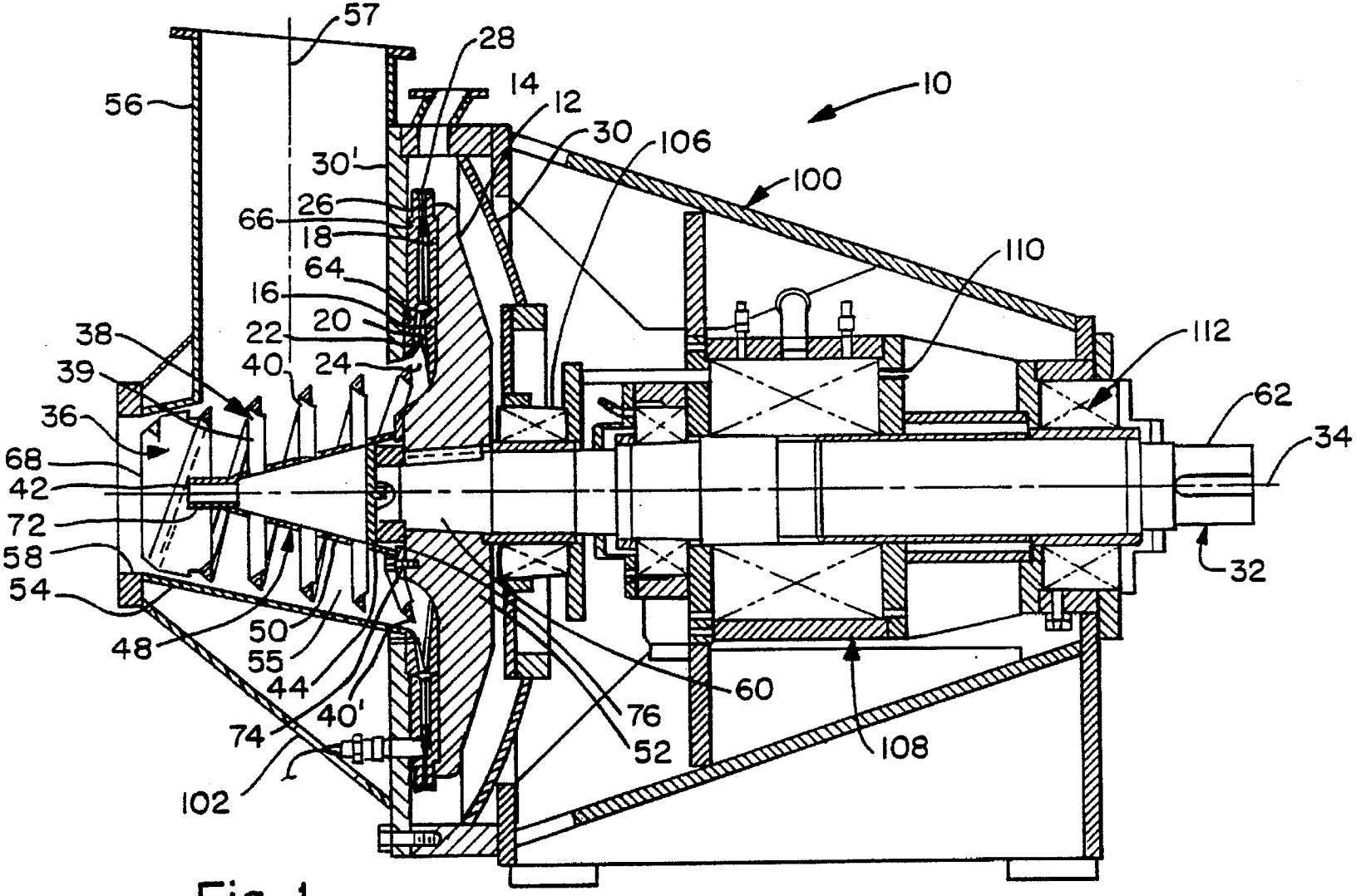
FIG. 1 is a schematic, section view of a high consistency disc refiner incorporating the preferred embodiment of the invention.
Figure 2:
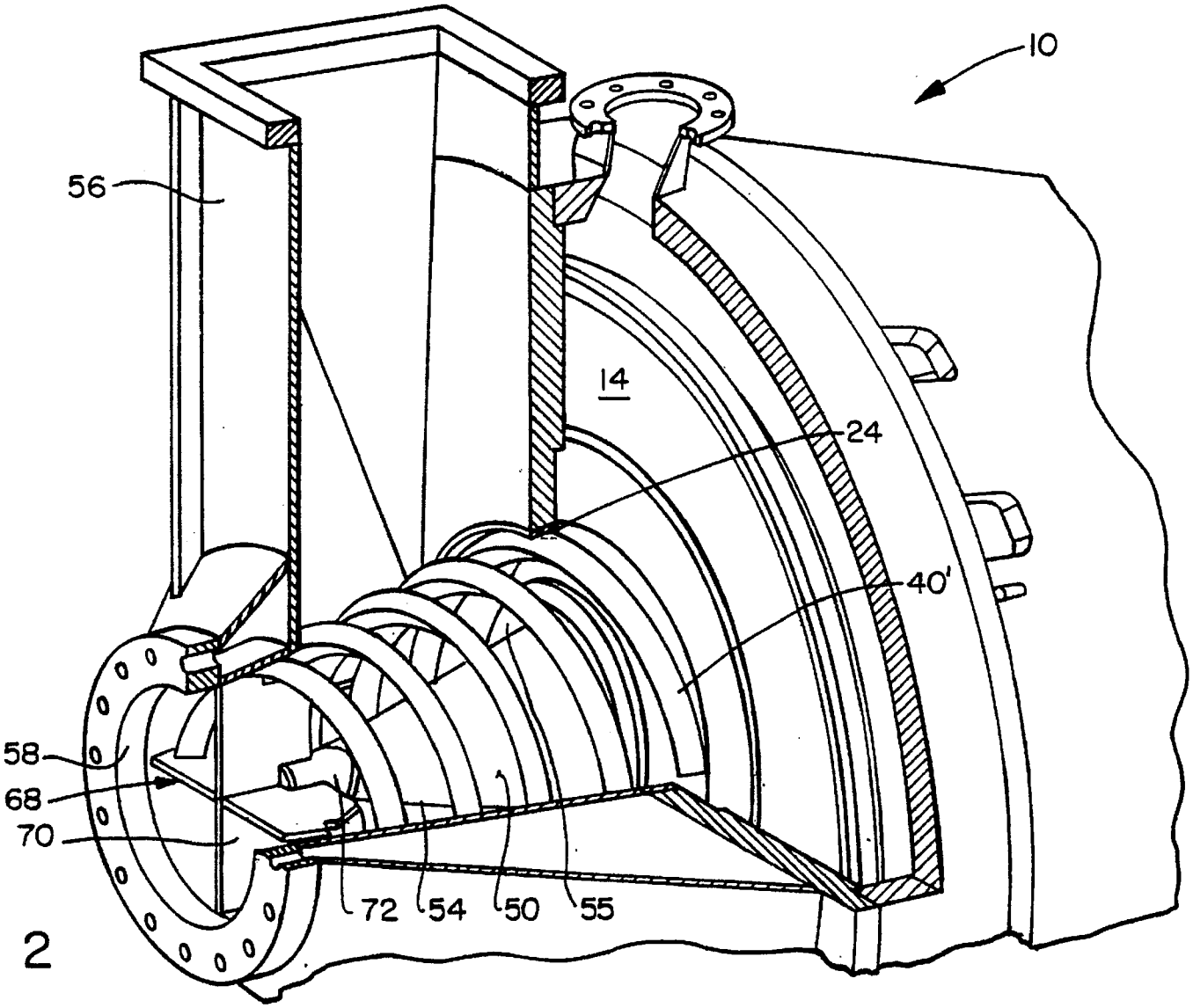
FIG. 2 is a perspective view of the improved feed assembly of the present invention, as included in the refiner depicted in FIG. 1.

FIGS. 1 and 2 show a disc refiner 10 and an enlarged perspective view of a portion thereof, respectively, for defibrating high consistency chips and the like, at superatmospheric heat and pressure. A rotatable disc 12 has a working face 14, which may include plates attached to the disc in a known manner. The working face 14 has a radially inner first inlet surface 16 and a radially outer first grinding surface 18. Surfaces 16,18, rotate with the disc. A second inlet surface 20 is juxtaposed with the first inlet surface 16, thereby forming an inlet gap 22 which has an inlet entrance 24. A second grinding surface 26 is juxtaposed with the first grinding surface 18, thereby forming a grinding gap 28 defining a refining zone extending substantially radially outwardly from the inlet gap 22.

In the illustrated embodiment, the second inlet surface 20 and second grinding surface are stationarily supported within the pressure casing 30, whereas the disc 12 rotates within the casing. A shaft 32 is connected to the disc for imparting the rotation of the disc about a rotation axis 34. The features of the refiner described to this point, can be as shown, or as have been commercialized in various other types of known refiners.

In accordance with the present invention, a feed mechanism 36 is supported for rotation about the rotation axis 34, to advance feed chips under pressure, toward the face 14 of the disc 12, and into the inlet gap 22. The feed mechanism includes a substantially helical ribbon 38 defined by a plurality of coiled turns 40, the turns having an increasing diameter from one end 42 of the feed mechanism, remote from the disc face 14, to the other end 44 of the feed mechanism at the face 14 of the disc. The perimeter of the turn 40' having the greatest diameter, is situated at the entrance 24 to the inlet gap 22.

The feed mechanism has an axially extending core 48, preferably including a conical portion 50 having an increasing diameter in the direction from the one end 42 toward the other end 44, preferably increasing in the same proportion as the increasing diameter of the turns 40. The helical ribbons 38 are spaced from and attached to the core 48 by means of posts 39.

A feed housing 54 which is also substantially conical, surrounds the ribbon turns 40, except for an opening 46 defined by the intersection of feed conduit 56. The feed conduit 56 defines a feed path 57 for supplying chips into the ribbon turns along a direction transverse to the rotation axis of the feed assembly. The space between the conical portion 50 of the feed assembly, and the outer diameter of the turns 40 (i.e., which substantially extends along the inner surface of the feed housing 54), defines a substantially annular channel 55, which has a substantially uniform flow cross-section when viewed along the rotation axis 34. The channel 55, however, has an increasing outer diameter as one looks to the right in FIGS. 1 and 2. The chips which are introduced into the feed assembly 36 from the feed path 57, tend to be forced against the feed housing 54 at the outer diameter of the turns 40, due to the centrifical force of the rotating feed assembly. Although some axial force component is provided due to the helical shape of the ribbon, in accordance with conventional ribbon feeders, the present invention provides an increasing ribbon diameter in the conveying direction, which increases the conveying force per unit mass of chips, in that direction.

Figure 3:
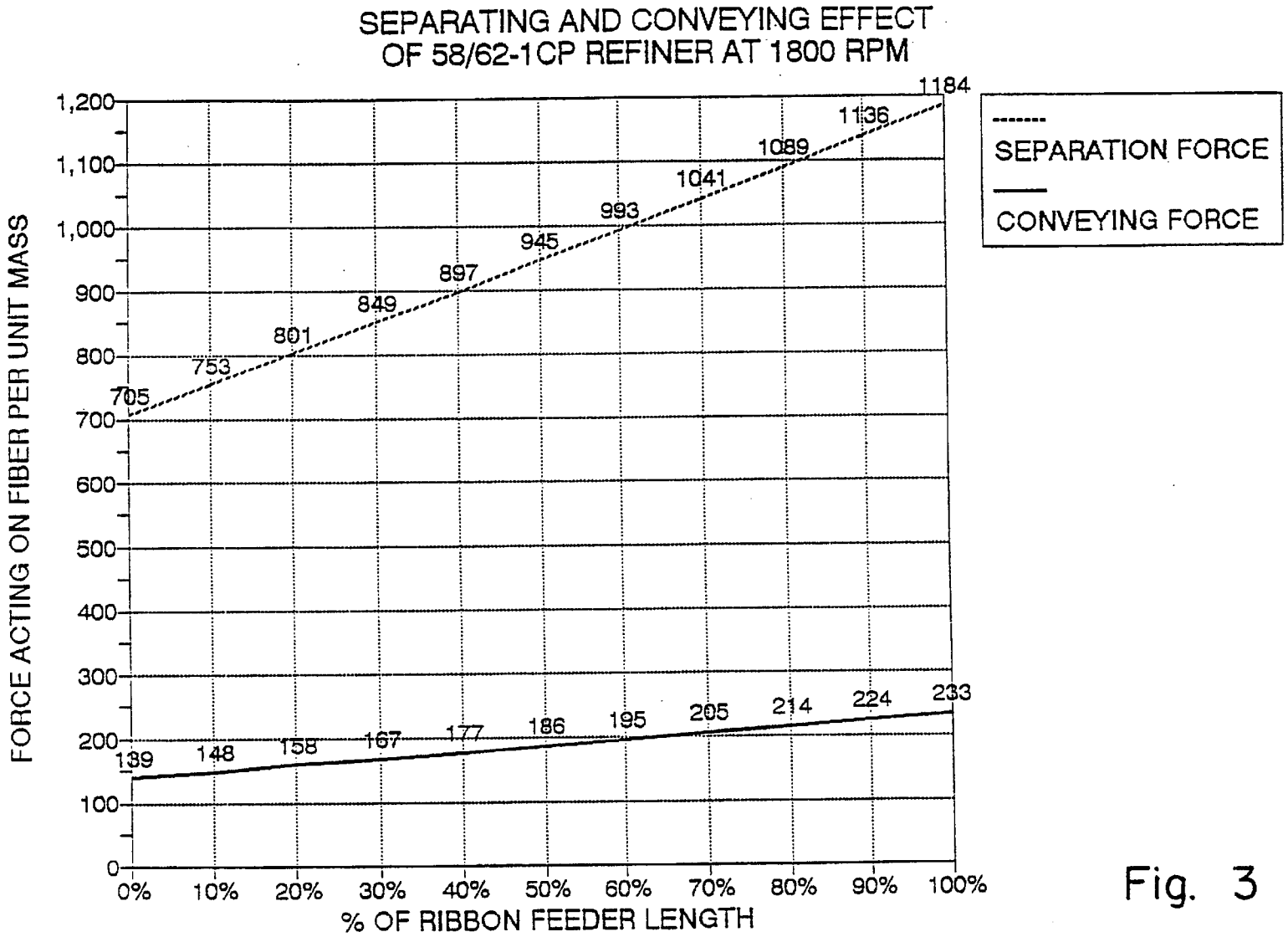
FIG. 3 is a graph illustrating the improvement in conveying force associated with the conical ribbon feeder of the present invention.

This effect can be seen in FIG. 3, where the theoretical separation force on the chips, tending to direct them radially outward due to circumferential force, is plotted as a percentage of the length of the feeder ribbons shown in FIGS. 1 and 2. Also shown is a similar plot of the conveying force, i.e., in the axial direction. Although the ratio of the separation force to the conveying force remains substantially constant along the ribbon feeder length, the present invention achieves a significant advantage, by increasing the absolute conveying force. The ratio is due to the cone angle. The conveying force along the length of the feeder increases from 139 to 233 times the force of gravity and is a force in addition to the conveying force provided by conventional cylindrical helical screw flights.

In the illustrated embodiment, the disc 12 is connected to the shaft 32 by a hub, or hub portion 52, and the feed mechanism is cantilevered from the hub, along the rotation axis. The ribbon thus is rotated by the disc shaft, at the same speed as the disc, e.g., 1800 rpm, or in more modern designs, a higher rate such as 2400 rpm. Where the outer diameter of turn 40' confronts the entrance 24 to the inlet gap 22, centrifugal force aggressively propels the chips outwardly into the gap. The refining action in the grinding gap 28 (i.e., the refining zone), generates steam, some of which flows radially outwardly from the disc, and some of which travels as a backflow out of the inlet gap 22. This backflow of steam is drawn along the radially inner portion of channel 55, in a direction away from the disc 12, and exits the refiner through the coaxial steam discharge conduit 58 formed in the feed housing 54. The feed mechanism 36 must convey the chips toward the right, in opposition to this backflowing steam, to the location at 40' where the centrifugal force assures that the chips are introduced into the entrance 24 and captured in the inlet gap 22.

This is facilitated by the very compact relationship of the feed assembly 36 to the disc hub 52, as a result of the bolted connection 74 of the core 48, or an extension thereof, to the hub 52. Preferably, in a single disc refiner as shown, one end 60 of the shaft 32 is secured to the hub 52, and the other end 62 remote from the disc face, is adapted to be driven rotatably. The casing front wall portion 30', preferably carries stationary plates 64,66 defining the second inlet surface and second grinding surfaces respectively. The perimeter of the coil turn having the greatest diameter 40' is spaced substantially vertically just below the plate 64. This assures that the chips at the entrance 24 to the inlet gap, maintain a substantially radial direction of movement.

The steam discharge end 42 of the feed assembly 36 includes an impeller 68 or the like having multiple radical blades 70, which are situated at least partly in the discharge conduit 58. The blades 70 preferably extend axially from the core 48 within at least one of the turns 40. The blades influence fibers entrained in the backflow steam to move radially toward the feed housing for reconveying with the chips toward the inlet gap 22. Preferably, the core 48 includes a substantially cylindrical portion 72 extending axially from the conical portion, and to which the blades are connected. The core itself, particularly the conical portion, has a major diameter end 76 with means, such as bolts 74, for attaching the major diameter end to the hub 52.

Other aspects of the refiner 10 can be somewhat conventional. A frame 100 surrounds the casing 30, and a stiffening structure 102 surrounds the feed assembly. Within the housing 100, but outside the casing 30, components are provided for performing conventional functions in a high consistency refiner. For example, a seal as indicated at 106, prevents leakage of the high pressure within the casing, along the shaft 12 into the housing. A thrust bearing arrangement 108 is provided to absorb any transients that might arise from the refining action at the disc face 14. This function may be provided within the same overall arrangement, as is provided for plate displacement control, indicated at 110, whereby the grinding gap 28 can be adjusted according to the type of chips being refined, or to achieve particular parameter targets as to the characteristics of the refined pulp. At least one shaft bearing is required, as indicated at 112.

Those familiar with this field of art will appreciate that the invention described herein may be incorporated into refiners other than the type shown in the accompanying figures. For example, in an alternative embodiment, the ribbon mechanism can be driven independently of the main drive shaft, by a dedicated external motor. It should also be understood that, as said herein, the term "conical" is intended to include "frustoconical".

What is claimed is:

1. A refiner for defibrating lignocellulosic feed material comprising:

a rotatable disc having a working face including a radially inner first inlet surface and a radially outer first grinding surface;

a second inlet surface juxtaposed with said first inlet surface, thereby forming an inlet gap which has an inlet entrance;

a second grinding surface juxtaposed with said first grinding surface, thereby forming a grinding gap extending substantially radially outwardly from said inlet gap;

a shaft connected to said disc for rotating the disc about a rotation axis;

a feed assembly including a feed mechanism supported for rotation about said rotation axis and a feed housing surrounding the feed mechanism, to advance feed material toward the face of said disc and into said inlet gap;

means for receiving feed material and directing said feed material to said feed assembly;

said feed mechanism including a substantially helical ribbon defined by coiled turns, the turns having an increasing diameter form one end of the feed mechanism remote from the disc face to another end of the feed mechanism at said face such that the perimeter of the turn at the greatest diameter of the ribbon, is situated at the entrance to said inlet gap; and said feed housing enlarges toward the face of said disc and closely surrounds said ribbon.

2. The apparatus of claim 1, wherein the feed mechanism further includes, an axially extending core within said ribbon and including a conical portion having an increasing diameter from said one end toward said other end of the feed mechanisms, thereby defining a channel between said core and ribbon.

3. The apparatus of claim 2, wherein the refiner has a single disc connected to one end of said shaft, said shaft having another end remote from the disc face, and adapted to be rotatably driven;

said disc is contained within a stationary casing to which said plate means defining the second inlet surface and the second grinding surface are fixedly attached; and the perimeter of the coil turn having the greatest diameter, is substantially closely spaced vertically from said plate means defining said second inlet surface.

4. The apparatus of claim 1, wherein said feed mechanism is rotated by said shaft and corotatable with said disc.

5. The apparatus of claim 4, wherein said disc is connected to said shaft by means of a hub and said feed mechanism is cantilevered from said hub along said rotation axis.

6. The apparatus of claim 5, wherein said feed housing surrounding said ribbon is substantially frustoconical, said feed mechanism includes an axially extending substantially conical core spaced from said ribbon, thereby defining a channel between said core and ribbon, said means for receiving and directing feed material includes a feed conduit defining a feed path into said feed housing to said ribbon along a direction transverse to said rotation axis; and said feed housing includes a steam discharge conduit extending coaxially relative to said one end of the feed mechanism.

7. The apparatus of claim 6, wherein said one end of the feed mechanism includes a multi-blade impeller situated at least partly in said steam discharge conduit.

8. The apparatus of claim 7, where the blades extend axially along the core within a coil turn.

9. The apparatus of claim 8, wherein the core includes a substantially cylindrical portion extending axially from the conical portion and to which said blades are connected.

10. The apparatus of claim 5, wherein said means for receiving and directing feed material includes a feed conduit defining a feed path into said feed housing along a direction transverse to said rotation axis.

11. The apparatus of claim 10, wherein said feed housing includes a steam discharge conduit extending coaxially relative to said one end of the feed mechanism.

12. The apparatus of claim 4, wherein said means for receiving and directing feed material includes a feed conduit defining a feed path into said ribbon along a direction transverse to said rotation axis.

13. The apparatus of claim 1, wherein said means for receiving and directing feed material includes a feed conduit defining a feed path into said feed housing along a direction transverse to said rotation axis.

14. The apparatus of claim 13, wherein the refiner has a single disc connected to one end of said shaft, said shaft having another end remote from the disc face, and adapted to be rotatably driven;

said disc is contained within a stationary casing to which said plate means defining the second inlet surface and the second grinding surface are fixedly attached; and the perimeter of the coil turn having the greatest diameter, is substantially closely spaced vertically from said plate means defining said second inlet surface.

15. A refiner for defibrating lignocellulosic material comprising:

a rotatable disc having a working face including a radially inner first inlet surface and a radially outer first grinding surface;

a second inlet surface juxtaposed with said first inlet surface, thereby forming an inlet gap which has an inlet entrance;

a second grinding surface juxtaposed with said first grinding surface, thereby forming a grinding gap extending substantially radially outwardly from said inlet gap;

a shaft connected to said disc for rotating the disc about a rotation axis;

a feed assembly including a feed mechanism supported for rotation about said rotation axis and a feed housing surrounding the feed mechanism, to advance feed material toward the face of said disc and into said inlet gap;

means for receiving feed material and directing said feed material to said feed assembly;

wherein said feed mechanism includes an elongated core having a first end remote from said face and a second end at said face, and a helically coiled ribbon supported by and extending longitudinally in spaced relation with the core, the ribbon defined by turns having an increasing in diameter along the core toward said face; and wherein said feed housing includes a conical portion closely surrounding the ribbon and an opening remote from said face through which feed material is directed into the ribbon by said means for receiving and directing.

* * * * *

UNITED STATES PATENT AND TRADEMARK OFFICE

CERTIFICATE OF CORRECTION

PATENT NO. : 5,626,300

DATED : May 6, 1997

INVENTOR(S) : Gregory R. Kohler

It is certified that error appears in the above-indentified patent and that said Letters Patent is hereby corrected as shown below:

Column 5, line 50, "mechanisms" should read --mechanism--.

Signed and Sealed this

Twenty-eighth Day of April, 1998

Bruce Lehman

*Attest:*

BRUCE LEHMAN

*Attesting Officer*

*Commissioner of Patents and Trademarks*